US009646449B2

(12) United States Patent
Schmitz et al.

(10) Patent No.: US 9,646,449 B2
(45) Date of Patent: May 9, 2017

(54) METHOD AND SYSTEM FOR HANDLING VALUE DOCUMENTS

(71) Applicant: GIESECKE & DEVRIENT GMBH, München (DE)

(72) Inventors: Jürgen Schmitz, Holzkirchen (DE); Rudolf Christl, München (DE); Alfred Schmidt, München (DE)

(73) Assignee: GIESECKE & DEVRIENT GMBH, Munich (DE)

( * ) Notice: Subject to any disclaimer, the term of this patent is extended or adjusted under 35 U.S.C. 154(b) by 0 days.

(21) Appl. No.: 15/025,974

(22) PCT Filed: Sep. 29, 2014

(86) PCT No.: PCT/EP2014/002644
§ 371 (c)(1),
(2) Date: Mar. 30, 2016

(87) PCT Pub. No.: WO2015/043762
PCT Pub. Date: Apr. 2, 2015

(65) Prior Publication Data

US 2016/0217640 A1 Jul. 28, 2016

(30) Foreign Application Priority Data

Sep. 30, 2013 (DE) ..... 10 2013 016 383

(51) Int. Cl.
*G07F 7/04* (2006.01)
*G07F 19/00* (2006.01)
*G07D 11/00* (2006.01)

(52) U.S. Cl.
CPC ..... *G07D 11/0006* (2013.01); *G07D 11/0051* (2013.01); *G07F 7/04* (2013.01); *G07F 19/00* (2013.01)

(58) Field of Classification Search
CPC ..... G07D 11/0006; G07D 11/0051; G07D 11/0084; G07F 7/04; G07F 19/00
See application file for complete search history.

(56) References Cited

U.S. PATENT DOCUMENTS 5,917,930 A 6/1999 Kayani et al.
7,133,741 B2 11/2006 Matzig et al.
(Continued)

FOREIGN PATENT DOCUMENTS

DE 10049432 A1 4/2002
DE 10226540 A1 1/2004
(Continued)

OTHER PUBLICATIONS

German Search Report for corresponding German Application No. 102013016383.8, Mar. 27, 2014, (5 pages).
(Continued)

*Primary Examiner* — Mark Beauchaine
(74) *Attorney, Agent, or Firm* — Workman Nydegger

(57) ABSTRACT

The invention concerns the processing of value documents of different deposits using a value-document processing apparatus. Upon insertion of the value documents into the containers with which they are fed to the value-document processing apparatus, a beginning position and, where applicable, also an end position of the respective deposit is established for each deposit and transmitted to the value-document processing apparatus. Even in the case of different deposits in the same container, the invention enables an error-free association of the checked value documents with the different deposits. When a deposit comprises two separate sub-stacks that were inserted in the same or different containers, said sub-stacks of the contemplated deposit can be brought to account jointly and a joint rejects processing of the sub-stacks of the same deposit carried out.

17 Claims, 4 Drawing Sheets

(56) References Cited

U.S. PATENT DOCUMENTS

| | | | | |
|---|---|---|---|---|
| 7,377,423 | B2 | 5/2008 | Demmeler et al. | |
| 8,794,510 | B2 | 8/2014 | Buchmann et al. | |
| 2002/0040865 | A1 | 4/2002 | Steinkogler et al. | |
| 2004/0012144 | A1 | 1/2004 | Matzig et al. | |
| 2005/0209966 | A1 | 9/2005 | Demmeler et al. | |
| 2009/0026116 | A1 | 1/2009 | Lubbers | |
| 2012/0175217 | A1* | 7/2012 | Demmeler ..... | B65H 1/027 194/206 |
| 2012/0197433 | A1 | 8/2012 | Buchmann et al. | |

FOREIGN PATENT DOCUMENTS

| | | | |
|---|---|---|---|
| DE | 102009034065 | A1 | 1/2011 |
| DE | 102009042891 | A1 | 3/2011 |

OTHER PUBLICATIONS

Intemational Preliminary Report on Patentability for corresponding International PCT Application No. PCT/EP2014/002644, Apr. 5, 2016, (9 pages).

Intemational Search Report for corresponding International PCT Application No. PCT/EP2014/002644, Nov. 12, 2014, (5 pages).

* cited by examiner

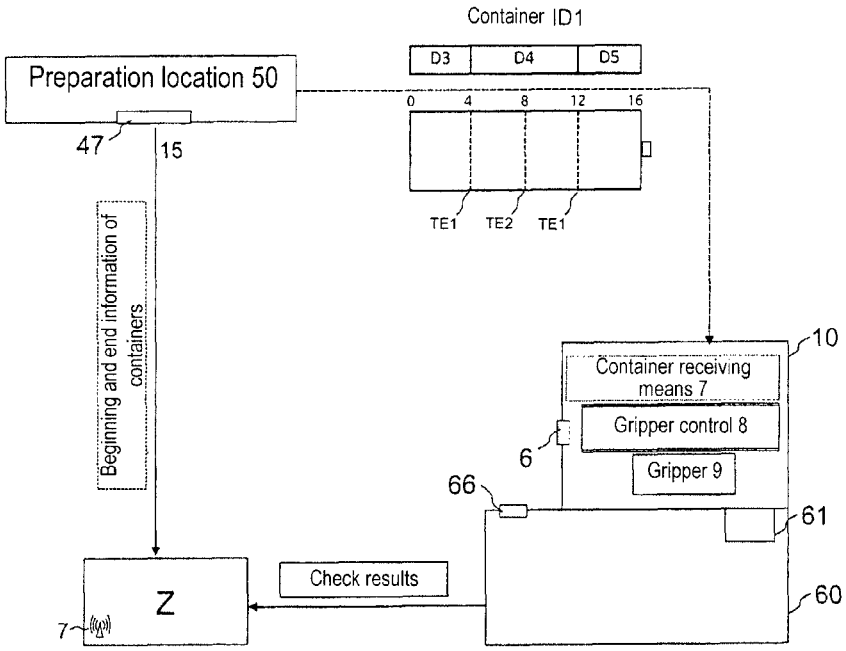

Fig. 3a

Beginning and end information of container ID1:

Container ID1
Deposit D3
Beginning = Position 0
End = Position 4

Container ID1
Deposit D4
Beginning = Position 4
End = Position 12

Container ID1
Deposit D5
Beginning = Position 12
End =

Check results of container ID1:

Container ID1
Stack from positions 0 to 4
1500 x 20€
30,000€

Container ID1
Stack from positions 4 to 8
2000 x 10€
20,000€

Container ID1
Stack from positions 8 to 12
2000 x 10€
20,000€

Container ID1
Stack from positions 12 to 16
1000 x 50€
50,000€

Fig. 3b

METHOD AND SYSTEM FOR HANDLING VALUE DOCUMENTS

BACKGROUND

This invention concerns a method and a system for processing value documents.

Before value documents are processed with a value-document processing apparatus they are usually prepared for the impending processing. The preparation of the value documents involves in particular capturing data or information of the deposit and making it available for the processing by the value-document processing machine. The data can comprise particulars about the depositor, an account number, the quantity and the value of the value documents forming the deposit, a unique transaction number, etc. In addition, the prepared value documents are inserted into containers that allow an automatic feed of the value documents to the value-document processing apparatus. For feeding the value documents to the value-document processing apparatuses there are employed e.g. containers that are open on one side and into which one or more value-document stacks of loose value documents are inserted, which stand on their longitudinal edges in the respective container.

The value documents can belong to different deposits which are respectively associated with a certain person, an account, an accounting unit, etc. The value documents of the deposits are usually bank notes, but can also comprise checks, vouchers or other value documents.

To enable uninterrupted processing by the value-document processing apparatus, the deposits are mutually separated by header cards or separation cards which are added between different deposits. The value-document processing apparatus recognizes said header cards or separation cards and thus also the start of each new deposit. The header cards have information on the deposit following after the respective header card. Said information is read by the value-document processing apparatus, so that the latter can associate value documents with the deposit to which they belong. If a plurality of containers are required for an extensive deposit, the order in which said containers are fed to the value-document processing apparatus must be heeded.

SUMMARY

Further, value-document containers are also known that have a plurality of compartments in which a value-document stack can be respectively inserted. Hitherto, each value-document stack that is inserted in the container in a separate compartment, i.e. separately from the other value-document stacks, forms a separate deposit and is also brought to account separately from the other value-document stacks of the container. Thus, for each value-document stack a separate accounting is carried out. The post-processing of rejects is also effected separately for each value-document stack. In so doing, the reject value documents that the value-document processing apparatus has sorted out of the relevant value-document stack are subjected to a manual or automatic check. Only after completion of the rejects post-processing does the value-document processing apparatus begin processing the next value-document stack.

On these premises, it is an object of the present invention to accelerate the automatic processing of the value documents.

This object is achieved by the features of the independent claims. The dependent claims contain advantageous developments of the invention.

For processing value documents of different deposits using a value-document processing apparatus, the following steps are carried out:

a) inserting value documents of different deposits into one or more containers, while placing a separating element into the respective container at each boundary between the value documents of two different deposits, b) transporting the containers into which the value documents of the different deposits were inserted to the value-document processing apparatus, c) transporting the value documents of the different deposits from the containers into an input pocket of the value-document processing apparatus, while removing the value documents from the respective container, along a certain removal direction of the respective container, and inserting them into the input pocket of the value-document processing apparatus stack by stack, d) checking the value documents of the different deposits by the value-document processing apparatus, while counting the value documents stack by stack in order to establish a stack-based value-document number in dependence on the respective value-document type. In so doing, the respective value-document number is established for each value-document type that is present in the respective stack. In the case of bank notes, the value-document type to be distinguished can be e.g. the denomination and/or the currency and/or the emission of the bank notes.

e) automatically bringing to account the different deposits that were checked by the value-document processing apparatus.

To obtain a high packing density of the value documents in the containers, it is desirable that the value documents of the different deposits are inserted into a plurality of containers such that the containers are filled with value documents as completely as possible. Said value documents are to be automatically removed from the containers, inserted into the value-document processing apparatus and checked by the latter. Even in the case of different deposits in the same container, the invention enables an error-free association of the checked value documents with the different deposits. There is enabled by the invention a reliable and error-free accounting of the value documents of different deposits in particular in the case when upon insertion of the value documents for at least one contemplated deposit the value documents of the contemplated deposit are divided into at least two sub-stacks that are inserted into the same or into different containers.

To obtain a joint accounting of said sub-stacks, there are established according to the invention for each deposit a beginning position and, where applicable, also an end position of the respective deposit upon insertion of the value documents into the container or containers. The beginning position and, where applicable, end position are established e.g. at a preparation location where the value documents are prepared for automatic processing, and said positions are transmitted to an accounting device which carries out the automatic accounting. The accounting device can be present in the value-document processing apparatus itself or in an input module of the value-document processing apparatus or in an IT system connected to the value-document processing apparatus.

Hereinafter a deposit will be contemplated that, upon insertion of the value documents, is divided into at least two sub-stacks that are inserted into the same or into different containers. If the value-document processing apparatus checks in immediate succession the sub-stacks of the contemplated deposit that were inserted in the same or in different containers, then the value documents of the at least two sub-stacks are brought to account jointly, with consideration of the contemplated deposit's beginning position and, where applicable, end position established upon insertion.

In particular, the at least two sub-stacks of the contemplated deposit are brought to account jointly by establishing from the stack-based value-document number that was established upon the stack-by-stack counting for the at least two sub-stacks in dependence on the respective value-document type, with consideration of the contemplated deposit's beginning position and, where applicable, end position established upon insertion, a resultant value-document number for each value-document type present in the contemplated deposit. For example, the stack-by-stack value-document number of the individual sub-stacks that is established upon checking is added up for each value-document type of the contemplated deposit to thereby establish the resultant value-document number of the contemplated deposit for the respective value-document type. The at least two sub-stacks of the contemplated deposit are then brought to account jointly on the basis of the resultant value-document number of each value-document type.

The value documents of the contemplated deposit are thus associated with the contemplated deposit on the basis of the established beginning position and, where applicable, end position. For the association of the value documents with the contemplated deposit, no header cards are required or employed.

If the contemplated deposit's beginning position and, where applicable, end position are already known to the value-document processing apparatus upon checking of the value documents (e.g. because they were transmitted from the preparation location to the value-document processing apparatus), the value-document processing apparatus can immediately determine from the stack-based value-document number for the contemplated deposit the resultant value-document number in dependence on the value-document type. Otherwise, the value-document processing apparatus can transmit the stack-based value-document number for each value-document type to the accounting device, which then establishes the resultant value-document number for each value-document type, on the basis of the contemplated deposit's beginning position and, where applicable, end position.

The value-document stacks of different deposits, which stacks are checked by the value-document processing apparatus, can hence be associated with the correct deposit automatically. No later, manual association of the respective value-document stacks with the respective deposits is necessary. The invention obtains a deposit-based association of the value-document stacks which makes it possible to distribute the contemplated deposit arbitrarily over a plurality of containers, whose processing order can be selected arbitrarily by the value-document processing apparatus. Further, the invention makes it possible to divide the contemplated deposit into a plurality of value-document stacks arbitrarily by (second-type) separating elements—even after the end of preparation of the value documents at the preparation location, i.e. later—e.g. in order to divide a value-document stack in a container into two or more sub-stacks when said stack is too large (for automatic removal by a gripper).

The containers respectively have in particular a pre-specified container start and a pre-specified container end. The value documents are so removed from the container that the value documents at the container start are inserted into the input pocket of the value-document processing apparatus first and the value documents at the container end last, viewed along the removal direction.

In one embodiment, there are established for each deposit both the beginning position and the end position of the different deposits. In this case, the correct association of the value-document stacks can be carried out for the contemplated deposit on the basis of the beginning and end positions of the contemplated deposit. The beginning/end positions of other deposits are not required for this purpose.

In another embodiment, only the beginning positions (and no end positions) of the different deposits are established. For the correct association of the value-document stacks with the contemplated deposit, there is then also required the beginning position of that (following) deposit whose value documents are contained in the relevant container or containers after those of the contemplated deposit, i.e. whose beginning also marks the end of the contemplated deposit. In this case, there are employed for the correct association of the value-document stack with the contemplated deposit the beginning position of that or those (following) deposit or deposits whose value documents are contained in the relevant container or containers after those of the contemplated deposit. That is to say, in this case the beginning positions of one or more other deposits are also taken into consideration for the correct association.

The beginning position/end position of a deposit is the information about in which of the value-document containers and after which separating-element position along the removal direction of this value-document container the respective deposit begins/ends. Preferably, a beginning position and, where applicable, the end position of the respective deposit are transmitted to the accounting device and, where applicable, also to the value-document processing apparatus for each of the deposits at a time before the checking and counting of the value documents of the respective deposit. The beginning position/end position of the respective deposit comprises that separating-element position after/before which the first/last value documents of the respective deposit are located in the respective container (viewed along the removal direction of the container).

The beginning position and, where applicable, end position can be transmitted e.g. via a data carrier of the value-document container or via a communication line which exists between the preparation location and the accounting device and, where applicable, the value-document processing apparatus. In the case of transfer of the beginning/end position via a communication line, the beginning position/end position also comprises an identification of the respective container into which the first/last value documents of the respective deposit were inserted. If the beginning position and, where applicable, end position were transmitted from the preparation location only to the accounting device of a surrounding IT system but not to the value-document processing apparatus, the value-document processing apparatus can direct a request to the IT system as needed in order to obtain information about the beginning positions and, where applicable, end positions of the deposits.

In the case of a division of the contemplated deposit over a first and a second container, the beginning position (but not the end position) of the contemplated deposit is associated with the first value-document container which is filled with the first sub-stack of the contemplated deposit, and the end position of the contemplated deposit (but not the beginning position) is associated with the second value-document container which is filled with the second sub-stack. The number and type of the checked value documents of the contemplated deposit as established by the value-document processing apparatus is associated on the basis of the (previously established) beginning position and, where applicable, end position of the contemplated deposit.

For each of the deposits the resultant value-document number of each value-document type present in the respective deposit is established, e.g. a numerical value for the respective value-document type. Upon accounting, a total value of the value documents of the deposit is established therefrom. For automatically bringing to account the different deposits that have been processed by the value-document processing apparatus, the respective deposit is brought to account automatically on the basis of the resultant value-document number of each value-document type present. The accounting device is configured for bringing a deposit to account, in the case when the value documents of said deposit were divided into at least two sub-stacks that were inserted into the same or into different containers, in such a way that it brings to account the at least two sub-stacks of the value documents of said deposit jointly on the basis of the value-document number of each value-document type as established for said deposit.

Reject value documents that were rejected upon checking of the value documents are sorted out by the value-document processing apparatus into a reject pocket of the value-document processing apparatus. In so doing, the sorted-out reject value documents of different sub-stacks that belong to the same deposit and were inserted into the same value-document container or into different containers are sorted out into the same reject pocket. Preferably, said reject value documents of the same deposit are post-processed jointly in one working step, in particular at a time before the contemplated deposit is automatically brought to account.

After the processing of the value documents of a contemplated deposit, as soon as value documents of another deposit are to be checked by the value-document processing apparatus, the value-document processing apparatus switches automatically to an operating mode for rejects post-processing of the reject value documents of the contemplated deposit. The switch to the rejects operating mode is effected in particular at a time before value documents of another deposit are inserted into the input pocket. If a great number of reject value documents occur, an additional rejects processing can also be carried out in between, i.e. before the check of the contemplated deposit is ended. The contemplated deposit is only automatically brought to account when the post-processing of the reject value documents of the contemplated deposit is terminated.

When the value documents of the contemplated deposit are divided, upon insertion, into at least two sub-stacks that are inserted in the same or in different containers, and the value-document processing apparatus checks the sub-stacks of said deposit in immediate succession, the reject value documents of said sub-stacks are sorted out into the same reject pocket. Before the value-document processing apparatus checks value documents of another deposit than the contemplated deposit, it switches automatically to an operating mode for rejects post-processing of the reject value documents of the contemplated deposit, in which mode the sorted-out reject value documents of the at least two sub-stacks of the contemplated deposit are post-processed jointly.

If a deposit is divided into at least two sub-stacks using at least one separating element (second-type separating element), the at least two sub-stacks of the contemplated deposit can be brought to account jointly. Reject value documents of all sub-stacks that are successively inserted into the same value-document container and that belong to the same deposit, said value documents being rejected upon checking thereof, are sorted out into the same reject pocket. And said reject value documents are post-processed jointly before the contemplated deposit is automatically brought to account. The value-document processing apparatus does not switch automatically between the processing of the at least two sub-stacks of the same deposit to an operating mode for rejects post-processing of the respective reject value documents of the respective sub-stack, but rather the reject value documents of all sub-stacks of the contemplated deposit that are inserted into the same value-document container are post-processed jointly in a post-processing step. This rejects post-processing can be carried out as soon as the last value documents of the respective container have been checked or, if a next container also begins with the same deposit, also at a later time.

The value documents of the contemplated deposit are distributed for example over at least two containers into which only value documents of the contemplated deposit, but no value documents of other deposits, are inserted. The contemplated deposit then comprises at least a first sub-stack in a first container and at least a second sub-stack in a second container. The accounting of the contemplated deposit's sub-stacks inserted into the first and second containers can then be carried out in any case jointly, independently of the order in which the value documents of the first container and of the second container are inserted into the input pocket of the value-document processing apparatus.

The value documents of the contemplated deposit can also be distributed over at least two containers such that the value documents of said deposit form a first sub-stack that is inserted at the end of the first container (viewed along the removal direction of the container) and form a second sub-stack that is inserted at the start of a second container (viewed along the removal direction of the container). Start and end of the respective container are viewed along the certain removal direction of the respective container. However, when one or both containers also contain value documents of one or more other deposits (e.g. at the start of the first container there can also have been inserted value documents of another deposit), then the contemplated deposit's sub-stacks inserted into the first and second containers are brought to account either jointly or separately from each other, in dependence on the order in which the value documents of the first and second containers of the value-document processing apparatus are inserted into the input pocket of the value-document processing apparatus. In this connection the following cases can occur:

If the order is such that the value documents of the second sub-stack (from the second container) are inserted into the input pocket of the value-document processing apparatus immediately after those of the first sub-stack (from the first container), then the value documents of the second sub-stack from the second container are brought to account jointly with the value documents of the first sub-stack from the first container, in a joint accounting. Said joint accounting can comprise—in addition to the first and second sub-stacks—one or more further sub-stacks of the same deposit that were inserted into one or more further containers, whose value documents were inserted before the value documents of the first container or after the value documents of the second container. Between the processing of the value documents of the first and second containers, no separate accounting of the value documents of the contemplated deposit with regard to the first sub-stack is thus carried out, and the value-document processing apparatus does not switch to an operating mode for rejects processing of the first sub-stack.

If the order is such that between the value documents of the first and second sub-stacks, value documents of another deposit from a next container are inserted into the input pocket (neither the value documents of the second container nor of a further container at whose start value documents of the contemplated deposit are contained), then an accounting of the contemplated deposit with regard to the first sub-stack from the first container is carried out between the processing of the value documents of the first and next containers, and at a later time an accounting, separate therefrom, of the contemplated deposit with regard to the second sub-stack from the second container. The mutually separate accountings of the two sub-stacks of the contemplated deposit can be merged manually or automatically at a later time in order to carry out a final accounting of the contemplated deposit.

If the order is such that the value documents of the second sub-stack are inserted into the input pocket of the value-document processing apparatus before those of the first sub-stack, then an accounting of the contemplated deposit with regard to the second sub-stack from the second container is carried out after the processing of the second sub-stack, and an accounting of the contemplated deposit with regard to the first sub-stack is carried out at a later time, being separate from the accounting with regard to the second sub-stack. The mutually separate accountings of the two sub-stacks of the contemplated deposit can be merged manually or automatically at a later time in order to carry out a final accounting of the contemplated deposit.

The contemplated deposit can comprise—in addition to the first and second sub-stacks—at least one further sub-stack which is contained in a further container containing only the value documents of the further sub-stack but no further value documents of other deposits. If the order is then such that the value documents from the at least one further container are inserted into the input pocket of the value-document processing apparatus immediately after the first sub-stack, and the value documents of the second sub-stack are inserted into the input pocket of the value-document processing apparatus immediately after the value documents of the at least one further container, then the value documents of the first sub-stack from the first container and the value documents of the second sub-stack of the second container and the value documents of the at least one further sub-stack from the at least one further container are brought to account together in a joint accounting.

It is a problem with separating different deposits by header cards as hitherto to process deposits with a very great quantity of value documents automatically. When the number of value documents is e.g. so great that the deposit does not have room in a container, the remaining sub-stack of the value documents of the contemplated deposit must be inserted into a further container. When the value documents are fed to the value-document processing apparatus the value documents of said containers must then be inserted in the correct order, in order for the value documents of the further container to be associated with the correct deposit.

The method according to the invention, in contrast, allows a more flexible processing of the containers in an arbitrary order and thus a more robust process of automatic value-document processing. Since the order in which the sub-stacks inserted in different containers are fed to the apparatus can be selected flexibly, those processing errors that have hitherto come about through a wrong container order are avoided by the invention. Moreover, when feed is in the "right" order (so that all value documents of the same deposit are inserted into the value-document processing apparatus in immediate succession) an elevated throughput of processing is obtained, since feed in the right order enables a joint accounting and joint rejects processing of the sub-stacks of the same deposit. However, when the containers are fed in another order an error-free accounting is nevertheless guaranteed.

Different types of separating elements can be employed. For example, upon insertion of the value documents of the different deposits into the one or more containers, a first-type separating element will be placed into the respective container at each boundary between value-document stacks of two different deposits. In the case of a deposit whose value-document stack extends over more than a maximum stack length along the removal direction in the respective container, the value-document stack of said deposit can be divided into at least two sub-stacks using at least one second-type separating element.

The first-type separating elements and the second-type separating elements can have different colors and/or be mechanically configured differently. For example, upon placement into the respective container the first-type separating elements are automatically fixed in the container such that the first-type separating elements do not fall out of the container when the container is turned around so that its open side points downward. The first-type separating elements have for this purpose e.g. a corresponding latch mechanism which prevents the separating element from falling out of the container. The second-type separating elements, in contrast, are so mechanically configured that they fall out of the container when the container is turned around so that its open side points downward.

The insertion of the value documents can be carried out using a gripper, which removes one value-document stack/sub-stack after the other from the respective container and inserts them into an input pocket of the value-document processing apparatus. The gripper can be part of an input module of the apparatus or part of a self-driving transport vehicle which transports the containers to the value-document processing apparatus. The value-document processing apparatus can be informed from outside, e.g. by the gripper control of the gripper, at what time the latter has inserted all sub-stacks of the contemplated deposit into the input pocket of the value-document processing apparatus.

The invention also concerns a system for processing value documents of different deposits which comprises one or more preparation locations where value documents of different deposits are prepared and inserted into one or more containers. At each boundary between the value documents of two different deposits a (first-type) separating element is placed into the respective container. The system moreover comprises at least one value-document processing apparatus to which the containers into which the value documents of the different deposits were inserted are transported, and which checks the value documents of the different deposits and establishes the value-document number of each value-document type present in the contemplated deposit. Moreover, the system comprises a transport device by which the value documents of the different deposits are transported from the containers into an input pocket of the value-document processing apparatus, with the value documents being removed from the respective container stack by stack and inserted into the input pocket of the value-document processing apparatus (e.g. using a gripper).

The system further includes an accounting device for automatically bringing to account the different deposits that were processed by the value-document processing apparatus. The accounting device is configured such that, in the case when the value-document processing apparatus checks in immediate succession the contemplated deposit's sub-stacks that were inserted in the same or in different containers, it brings to account the value documents of the at least two sub-stacks jointly, with consideration of the contemplated deposit's beginning position and, where applicable, end position established upon insertion. The accounting device is configured such that, in the case when the value documents of a deposit were divided into at least two sub-stacks that were inserted into the same or into different containers, it establishes for each value-document type from the stack-based value-document number of the sub-stacks, on the basis of the contemplated deposit's beginning position and, where applicable, end position, the resultant value-document number of the contemplated deposit, and brings to account the at least two sub-stacks of said deposit jointly in this manner. The respective deposit is brought to account automatically on the basis of the resultant value-document number of the respective value-document type that was established for the respective deposit.

Further, the system comprises a device that is configured for recording the beginning position and, where applicable, end position of each deposit. Said device can be a reading device which reads out the beginning position and, where applicable, end position from the data carrier of the container. However, the device can also be an interface at the preparation location, on the input module or on the value-document processing apparatus, which is configured for the input of the beginning position and, where applicable, end position by an operating person, and, where applicable, for transmitting the beginning position and, where applicable, end position to the accounting device, e.g. to an IT system connected thereto or to the value-document processing apparatus.

At the preparation location there is captured, for each sub-stack that is inserted into one or more containers, deposit information that is specific to the relevant sub-stack. For each sub-stack that is inserted in a container, e.g. the following deposit information is associated with the respective container containing the sub-stack:

- an individual identifier of the deposit to which the respective sub-stack belongs, information on the identity of the depositor,
- the beginning position and, where applicable, also the end position of the respective sub-stack,
- where applicable, information on the storage location/locations of the further sub-stacks of the deposit to which the respective partial deposit belongs, or also information on the number of sub-stacks that the deposit to which the respective sub-stack belongs contains,
- where applicable, information on the nominal value of the sub-stack.

With each sub-stack there can be associated status information on the processing status of the sub-stack, which is adapted in the course of its processing, e.g. status=unprocessed, status=prepared, status=processed, status=brought to account, . . . .

With each container there is associated the deposit information about the sub-stack inserted in the container. In one embodiment example, the associating of the deposit information with the respective container containing the sub-stack is effected by writing the deposit information to a data carrier of the respective container. In another embodiment example, the associating of the deposit information with the respective container is effected by transmitting the deposit information, linked with the respective container identification, to the accounting device (e.g. via a communication line).

BRIEF DESCRIPTION OF THE DRAWINGS

Hereinafter the invention will be explained by way of example with reference to the following figures. There are shown.

DETAILED DESCRIPTION OF VARIOUS EMBODIMENTS

Figure 1A:
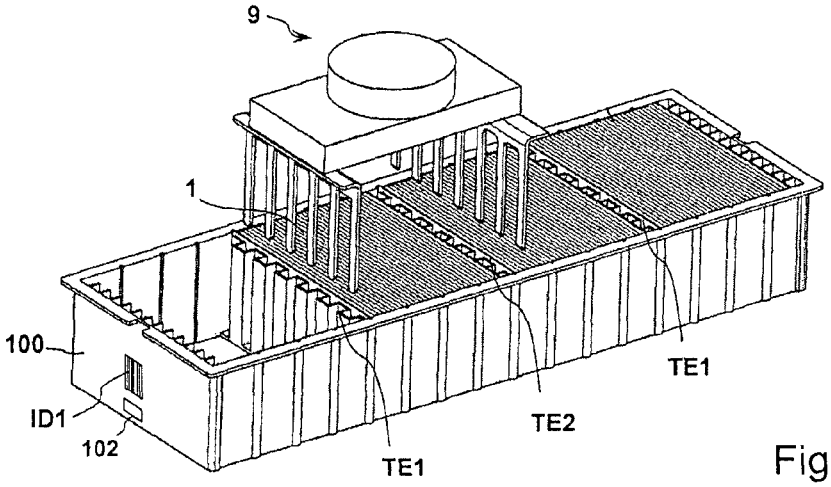
FIG. 1*a* a value-document container having a plurality of separating elements and a gripper for removing value documents from the container, FIG. 1*b* removal of the value documents from a value-document container by an input module which is attached to an apparatus for processing value documents, FIG. 2 examples of the deposit data stored in the data carrier of the containers, FIG. 3*a*-3*b* the possible information flow (FIG. 3*a*) and examples of the transmitted deposit data and check results (FIG. 3*b*), FIG. 4 a preparation location, an accounting device and a value-document processing apparatus to which the value documents are transported by a self-driving transport vehicle, FIG. 5 bringing the deposits to account in dependence on the order in which the containers are processed.

FIG. 1*a* shows a container 100 for receiving value documents, in which the value documents 1 are inserted so as to stand on their longitudinal edges. The value documents in the container 100 are divided into four value-document stacks by three separating elements TE1 and TE2. The left separating element TE1 forms the boundary between the value-document stack of a deposit D3, which is inserted in the left container portion, and a deposit D4 which is formed by the two middle value-document stacks. The separating element TE2 subdivides the deposit D4 into two sub-stacks. The right separating element TE1 forms the boundary between the deposit D4 and the value-document stack of the deposit D5, which is inserted in the right container portion.

The separating elements TE1 and TE2 can be positioned variably along the container to enable the size of the storage regions to be adapted to differently sized value-document stacks. For this purpose, the separating elements TE1, TE2 can be put in at different places of the container 100, where the container wall has corresponding slots. For removal of the value documents there is employed a gripper 9 which is lowered into the container 100 to remove the respective value-document stack of a storage region. The container 100 has an identification ID1 by which the container is uniquely identifiable. Said identification ID1 is marked e.g. by a bar code.

Optionally, the container 100 has a data carrier 102, e.g. an NFC chip, in which information about the value documents 1 contained in the container are stored. Said information can be read out from the NFC chip wirelessly using a corresponding reader.

Said information comprises e.g. information about the type of container, about the depositor of the respective value-document stack and, where applicable, about the number or the nominal value of the value documents of the respective value-document stack. In the data carrier 102 there can also be stored the beginning and end positions of the deposits, which are formed by the separating elements TE1. Optionally, there can also be stored in the data carrier the position of the separating element TE2, which does not form a beginning or end position of a deposit. Said information can have been stored in the data carrier 102 e.g. upon filling of the container with value documents, e.g. upon machine filling of the container, or upon manual filling of the container, e.g. by the depositor of the value documents, or at the preparation location 50 of an apparatus 60 for value-document processing, cf. FIG. 3*a*.

Figure 2:
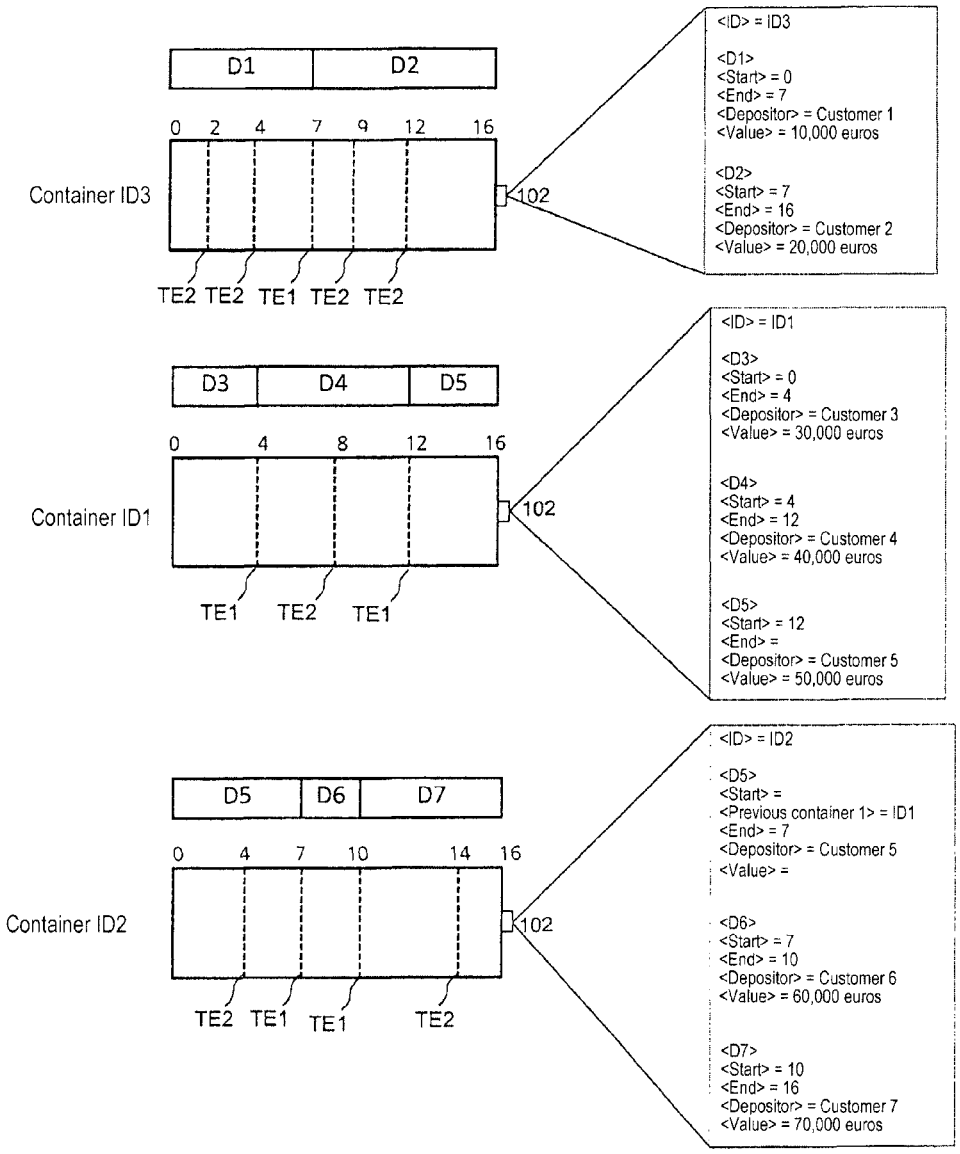

FIG. 2 shows the information stored in the data carrier 102 by the example of three containers ID1, ID2, ID3 in which value documents of seven different deposits D1-D7 are contained. The value-document stacks contained in the container ID1 have already been described above for FIG. 1*a*. In the container ID3 the two deposits D1 and D2 are contained and mutually separated at the position 7 of the container ID3 by means of a first-type separating element TE1. The deposit D1 is divided into three value-document stacks which are separated at the positions 2 and 4 by two second-type separating elements TE2. And the deposit D2 is divided into three value-document stacks which are separated at the positions 9 and 12 by two second-type separating elements TE2. In the container ID2 are located value-document stacks for the three deposits D5, D6 and D7. By means of a respective first-type separating element TE1 at the position 7 and at the position 10 of the container ID2 said three deposits are mutually separated. The deposit D5 is divided into two value-document stacks at the position 4 by a second-type separating element TE2. The deposit D6 consists only of one value-document stack which is located between the positions 7 and 10. The deposit D7 was divided into two value-document stacks which are separated at the position 14 by a second-type separating element TE2. Besides the start and end of the relevant value-document stack there are respectively also stated the depositor of the value-document stack, and the nominal value of the respective value-document stack as stated by the depositor. Said nominal value or the total value of the respective deposit is checked on the basis of the check results of the value-document processing apparatus 60 when the deposit is brought to account in the accounting device Z.

Figure 1B:
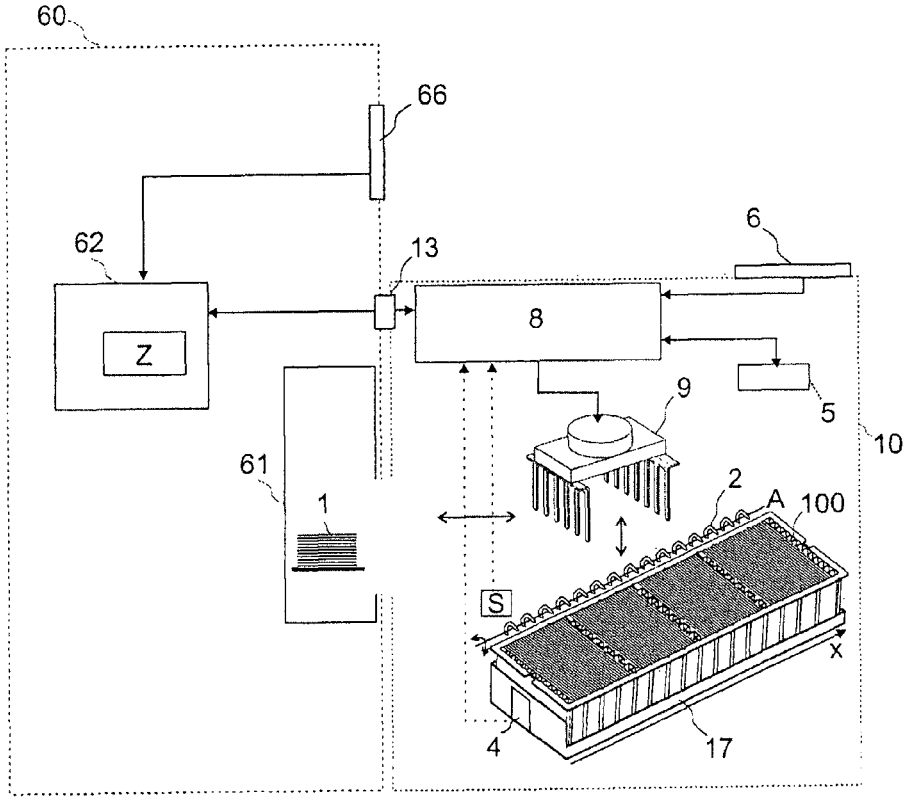

In FIG. 1*b* is represented an apparatus 60 for processing value documents, on whose input side an input module 10 is attached. The input module 10 is configured for the input of value documents, e.g. bank notes, to an input pocket 61 of the apparatus 60 and has for this purpose a gripper 9 which removes the value documents from a container 100 and inserts them into an input pocket 61 of the apparatus stack by stack. By the apparatus 60 the value documents 1 inputted to the input pocket are subsequently singled, transported, checked, sorted, where applicable, and placed in one or more output pockets of the apparatus 60. The apparatus 60 can be operated by an operating person via an operator interface 66. The input module 10 can be configured for receiving a plurality of value-document containers 100 and form a kind of buffer storage for the containers 100. For example, the input module 10 has a transport device which transports containers 100 filled with value documents into the capture region of the gripper 9 and transports the emptied containers, after removal of the value documents by the gripper 9, out of the capture region of the gripper 9 again. The input module can also have an operator interface 6.

The container 100 can be inserted into a container receiving means 17 of the input module 10 manually or automatically. The container receiving means 17 can be equipped with a reading device 4 for reading out the identification (e.g. ID1) of the container 100 and/or information about the beginning and end positions of the deposits in the container 100 from the data carrier 102 of the container. Where applicable, the separating-element position of the separating element TE2, which is not a beginning or end position of a deposit, can also be read out from the data carrier 102. However, the latter position can alternatively also be detected only in the input module 10.

In the case of the ID1 container, the reading device 4 transmits the read-out beginning and end positions of the deposits D3, D4 and D5, as well as the separating-element position of the separating element TE2, where applicable, to a gripper control 8 of the gripper 9, which controls the motion of the gripper 9. The gripper control 8 has e.g. a data carrier 5 in which the information, linked with the identification ID1 of the container 100, can be stored, as well as corresponding information for further containers with further identifications, where applicable. The gripper control 8 controls the gripper such that it successively removes the respective value-document stack inserted between two of the separating elements TE1, TE2 from the container 100 and inserts it into the input pocket 61 of the apparatus. Thus, the individual value-document stacks are automatically removed from the container 100 along the removal direction x, cf. FIG. 1*b*. The gripper control 8 can regularly inform the value-document processing apparatus 60, in particular its control 62, via the interface 13 about which value-document stacks the gripper 9 has already inserted from the container 100 into the input pocket 61 and which it has not yet inserted, i.e. which are still located in the container 100 at the respective time.

The positions of the separating elements TE1, TE2 can be established in the input module 10, using sensors of the input module 10, e.g. at a time before the gripper removes the value documents from the container. In FIG. 1*b* are shown for this purpose by way of example a multiplicity of mechanical sensors 2 which are arranged at certain positions along the longitudinal direction of the container receiving means 17. The mechanical sensors 2 have swivel fingers which swivel jointly around an axis A to check whether or not a separating element TE1 or TE2 is actually present at the respective position of the container 100. If the respective swivel finger encounters mechanical resistance upon swiveling, it is retained by the separating element TE1, TE2 and cannot follow the deflection of the other swivel fingers around the axis A. The respective sensor 2 detects the individual deflection of the respective swivel finger, e.g. by means of an inductive switch, a light barrier, or the like. The individual sensors 2 are connected to a sensor control S (connection not shown), which then transmits the corresponding information about the separating-element positions of the container 100 to the gripper control 8. Instead of the mechanical sensors 2, there can also be employed electrical, acoustic, optical, magnetic or other sensors, which are e.g. analogously arranged along the longitudinal direction of the container receiving means 17. However, the input module 10 can alternatively also have an image sensor (not shown) which respectively records an image of the next container to be processed, establishes the positions of the separating elements by means of image processing, and transmits this information to the gripper control 8. The separating-element positions can be established either individually for the respective container, or the respective container is associated on the basis of its ID with one of a plurality of pre-specified sorts of container whose separating-element positions are priorly known.

The apparatus 60 can carry out the accounting of the deposits either itself (accounting device Z in the apparatus 60) or transmit the inputted information to a central accounting device Z which is supplied by an IT system connected to the apparatus 60, and which can also carry out the accountings for a plurality of value-document processing apparatuses.

Further, the established positions of the separating elements can be checked before the gripper 9 begins removing the value documents 1. This can involve checking e.g. the distance between two neighboring separating elements as to whether the gripper 9 can safely remove the value-document stack located there between. If the value-document stack is too large for the gripper, the operator can be prompted to insert an additional separating element TE2 and thereby subdivide the oversized value-document stack into two smaller stacks which the gripper 9 can then remove.

Additionally or alternatively to storage in the data carrier 102 of the container, however, the information about the beginning and end positions of the deposits of the container 100 and of further containers with further deposits can also be transmitted directly to the accounting device Z. If the accounting device Z is arranged outside the apparatus 60, it usually carries out the accountings for a plurality of value-document processing apparatuses.

FIG. 3*a* shows the possible information flow of the information about the beginning and end positions of the deposits for an embodiment example in which the beginning and end positions of the deposits are established at a place spatially remote from the input module 10 and the value-document processing apparatus 60. The spatially remote position is e.g. a preparation location 50 which is equipped with an operator interface 47, e.g. a preparation location according to FIG. 4, or an office of a depositor. At the preparation location 50 the respective beginning and end positions of the deposit are established by an operating person and inputted at the operator interface 47 while being associated with the identification of the respective deposit and linked with the container identification ID of the respective container.

Figure 4:
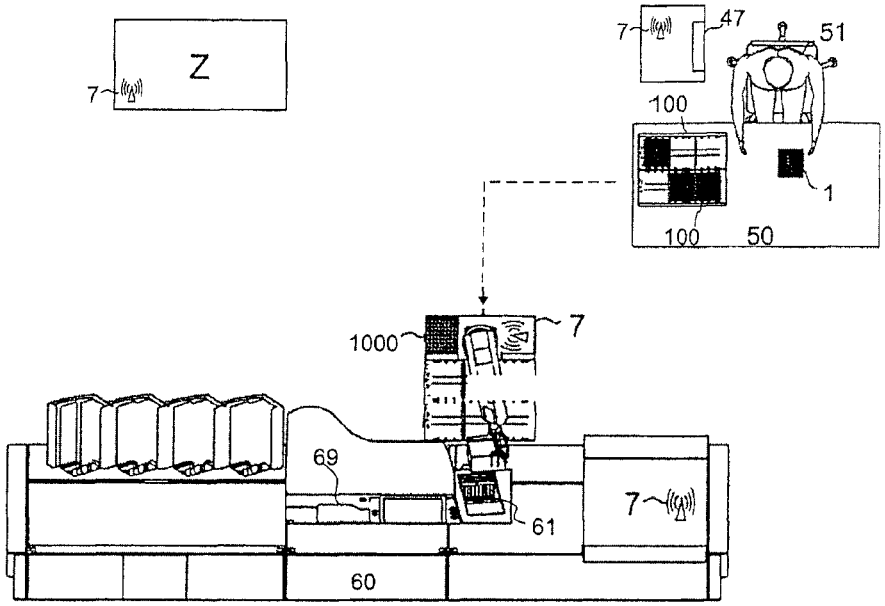

At one or more such preparation locations 50 the containers 100 are prepared by an operating person 51 for automatic removal of the value documents, cf. FIG. 3*a* and FIG. 4. The preparation comprises e.g. checking the containers, if the containers arrive at the preparation locations already loaded with value documents. However, filling the containers with value documents 1 can also be carried out only at the preparation locations 50. The separating elements TE1 bounding the deposits are also placed into the containers by the operating person 51. The preparation by the respective operating person 51 can also comprise establishing the beginning and end positions of the deposits, in particular establishing the positions of the separating elements TE1. The operating person 51 inputs the separating-element position of the separating elements TE1 on the operator interface 47 of the preparation location 50, cf. FIG. 4. In so doing, digital information about the beginning and end positions of the deposits of the respective container is generated, and linked with a container identification ID of the respective container. Using the linkage, the appurtenant information about the beginning and end positions of the deposits of the respective container can be determined, on the basis of the container identification ID, upon the later value-document removal.

FIG. 4 shows an embodiment example in which an automated guided vehicle 1000 fetches the containers 100 filled with value documents from a preparation location 50 and brings them to a value-document processing apparatus 60. The central accounting device Z is supplied by a server of the IT system which is connected to the value-document processing apparatuses 60 and the automated guided vehicles 1000 via wireless communication lines which exist between the communication interfaces 7 and via which information about the processed value documents is exchanged. The central accounting device Z can also be configured for controlling a plurality of transport vehicles. From it the automated guided vehicles obtain via their communication interface 7 e.g. orders to fetch value documents from one of the preparation locations 50 and to transport them to one of the value-document processing apparatuses 60.

The digital information generated at the spatially remote position about the beginning and end positions, linked with the container identification ID, of the deposits of the respective container is subsequently sent to the central accounting device Z via data connections 15. For the container ID1 the information represented on the left in FIG. 3*b*, for example, is sent to the central accounting device Z. The correct information about the beginning and end positions of the deposits is then associated with the respective container using the container identification ID and the position of the respective value-document stack in the respective container. For example, the container identification ID1 of the container 100 is read in by a reading device of the value-document processing apparatus 60 or of the input module 10. The value documents which the gripper has removed stack by stack from the respective container between the respective separating elements TE1, TE2 are checked stack by stack by the apparatus 60. Each checked stack thereby obtains as an identification the container identification and the position of the respective stack in the respective container. The apparatus 60 associates with each individual value-document stack its stack-based check results, e.g. the stack-based value-document number for each value-document type contained in the respective stack, and/or the total value of the respective value-document stack. The stack-based check results obtained for the value-document stacks from the container ID1 are represented on the right in FIG. 3*b*. Said stack-based check results are sent from the apparatus 60 to the central accounting device Z. The central accounting device Z then associates the stack-based check results with the respective deposits whose beginning and end positions it has obtained from the operating person 51 at the preparation location 50.

The central accounting device Z then carries out an accounting of the value documents of the different deposits. For each deposit the total value of the deposited value documents is determined. In the example of FIG. 3*b*, the check results of the stack that was contained in the container ID1 between the positions 0 and 4 are associated with the deposit D3. According to the stack-based check results, the deposit D3 comprised 30,000 euros. There are added up for the deposit D4 the check results of the stack that was inserted between the positions 4 and 8, and additionally of the stack that was inserted between the positions 8 and 12. The depositor of the deposit D4 is credited with 40,000 euros. Since the deposit D5 comprises no end position (the remainder of the deposit D5 being located in another container), the deposit D5 is not yet finally brought to account by the accounting device, but rather there is first associated with the deposit D5 only the 50,000 euros from the container ID1 (at positions 12-16). Only when all value-document stacks of the deposit D5 have been checked is the accounting of the deposit D5 terminated.

Figure 5:
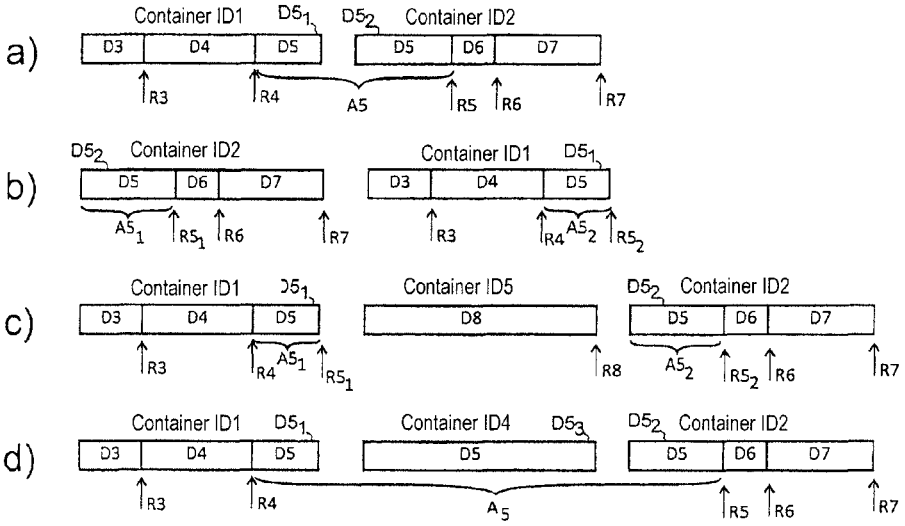

In FIG. 5 is represented how the deposits are brought to account in dependence on the order in which the value documents of the different containers are inserted into the input pocket of the apparatus 60. The value documents from the containers ID1, ID2 (and ID4, ID5, where applicable) are inserted into the apparatus and checked by the latter in temporal succession, with the time axis extending from the left to the right in FIG. 5. The removal direction x within the containers also respectively extends from the left to the right.

In the example of FIG. 5*a*, there are first processed the value documents from the container ID1 and subsequently those from the container ID2. The deposits D3 and D6 respectively comprise only one value-document stack, and the deposits D4 and D7 respectively two sub-stacks (cf. FIG. 2). The two sub-stacks of the deposit D4 are processed in immediate succession and hence also brought to account jointly, as are the two sub-stacks of the deposit D7. The deposit D5 comprises a sub-stack $D5_1$ at the end of the container ID1 and two sub-stacks $D5_2$ at the start of the container ID2. The order in which the value documents of said containers are fed to the value-document processing apparatus 60 is such here that the value documents of the container ID2 are fed to the value-document processing apparatus immediately after those of the container ID1. Hence, the value documents of the sub-stack $D5_2$ of the deposit D5 which were contained in the container ID2 are brought to account jointly with the value documents of the sub-stack $D5_1$ of the deposit D5 which was contained in the container ID1, in a joint accounting A5.

The reject value documents which the value-document processing apparatus 60 rejects upon checking are automatically sorted out into a reject pocket 69 and subsequently either post-processed manually or checked again by the value-document processing apparatus 60, cf. FIG. 4. The rejects post-processing of the respective deposit is preferably carried out before the value documents of the next deposit are processed by the value-document processing apparatus 60. After each of the deposits D3, D4, D6 and D7 there is respectively carried out a rejects post-processing R3, R4, R6, R7 of the reject value documents of the respective deposit. For the sub-stacks $D5_1$ and $D5_2$ of the deposit D5 not only the accounting, but also the rejects post-processing is combined. There is hence carried out—across containers—only one rejects post-processing R5 for the deposit D5.

In the example of FIG. 5*b*, the order is reversed, so that the value documents from the container ID2 are first processed by the value-document processing apparatus 60 and subsequently those from the container ID1. Since value documents of the deposits D6, D7, D3 and D4 are also processed between the sub-stacks of the deposit D5, two mutually separate accountings $A5_1$ and $A5_2$ are carried out for the deposit D5 in this case. For the separate accountings a virtual beginning position of the deposit D5 at the position 0 of the container ID2 is assumed, and a virtual end position of the deposit D5 at the position 16 of the container ID1. The rejects post-processing is also effected separately for the value-document stacks of the deposit D5 that are located in the different containers, i.e. a rejects post-processing ($R5_1$) is carried out both for the sub-stacks $D5_2$ of the deposit D5 from the container ID2 and for the sub-stack $D5_1$ of the deposit D5 from the container ID1 ($R5_2$). The mutually separate accountings of the two sub-stacks of the contemplated deposit D5 are merged at a later time in order to carry out a final accounting of the total deposit D5.

In the example of FIG. 5*c*, there is processed—unlike the example from FIG. 5*a*—between the containers ID1 and ID2 a further container ID5 in which value documents of a further deposit D8 are contained. In this case, separate accountings $A5_1$ and $A5_2$ are carried out for the sub-stack $D5_1$ of the deposit D5 of the container ID1 and for the sub-stack $D5_2$ of the deposit D5 of the container ID2, and also two mutually separate rejects post-processings $R5_1$ and $R5_2$. For the separate accountings a virtual end position of the deposit D5 at the position 16 of the container ID1 and a virtual beginning position of the deposit D5 at the position 0 of the container ID2 are also assumed in this case. The mutually separate accountings of the two sub-stacks of the contemplated deposit D5 are merged at a later time in order to carry out a final accounting of the total deposit D5.

In the example of FIG. 5*d*, the deposit D5—unlike the previous examples—also comprises value documents $D5_3$ in a further container ID4 in which only value documents of the deposit D5 but no value documents of another deposit are located. The value documents $D5_3$ from the container ID4 are processed by the value-document processing apparatus 60 between those from container ID1 and from container ID2. Since all sub-stacks of the deposit D5 are processed in immediate succession in this case, the sub-stacks of the deposit D5 of all three containers ID1, ID4 and ID2 are brought to account in a joint accounting A5, and a joint rejects post-processing R5 is also carried out for all sub-stacks of the deposit D5.

The invention claimed is:

1. A method for processing value documents of different deposits using a value-document processing apparatus, having the steps of:

a) inserting value documents of different deposits into one or more containers, while placing a separating element into the respective container at each boundary between the value documents of two different deposits in a container;

b) transporting the containers into which the value documents of the different deposits were inserted to the value-document processing apparatus;

c) transporting the value documents of the different deposits from the containers into an input pocket of the value-document processing apparatus, while removing the value documents from the respective container, along a removal direction, and inserting them into the input pocket of the value-document processing apparatus stack by stack;

d) checking the value documents of the different deposits by the value-document processing apparatus, while counting the value documents stack by stack to establish a stack-based value-document number in dependence on the respective value-document type;

e) automatically bringing to account the different deposits that were checked by the value-document processing apparatus;

wherein a beginning position and, where applicable, also an end position of the respective deposit are established for each deposit upon insertion of the value documents and then transmitted to an accounting device; and upon insertion of the value documents for at least one contemplated deposit the value documents of the contemplated deposit are divided into at least two sub-stacks that are inserted into the same or into different containers; and wherein in the case when the value-document processing apparatus checks in immediate succession at least two sub-stacks of the contemplated deposit that were inserted in the same or in different containers, then the value documents of the at least two sub-stacks are brought to account jointly, with consideration of the contemplated deposit's beginning position and, where applicable, end position established upon insertion.

2. The method according to claim 1, wherein upon bringing to account the contemplated deposit the at least two sub-stacks of the contemplated deposit are brought to account jointly by establishing from the stack-based value-document number that was established upon the stack-by-stack counting for the at least two sub-stacks in dependence on the respective value-document type, with consideration of the contemplated deposit's beginning position and, where applicable, end position established upon insertion, a resultant value-document number for each value-document type present in the contemplated deposit.

3. The method according to claim 1, wherein the value-document processing apparatus checks in immediate succession the sub-stacks of the contemplated deposit that were inserted in the same or in different containers; and the value-document processing apparatus sorts out reject value documents that were rejected upon checking of the value documents into a reject pocket of the value-document processing apparatus, with the sorted-out reject value documents of the sub-stacks that belong to the contemplated deposit being sorted out into the same reject pocket; and before the value-document processing apparatus checks value documents of another deposit it switches automatically to an operating mode for rejects post-processing of the reject value documents of the contemplated deposit, in which mode the sorted-out reject value documents of the at least two sub-stacks of the contemplated deposit are post-processed jointly.

4. The method according to claim 1, wherein a first sub-stack of the value documents of the contemplated deposit is inserted at the end of a first container, and a second sub-stack of the value documents of the contemplated deposit is inserted at the start of a second container, and the value documents of the second container are inserted into the input pocket of the value-document processing apparatus immediately after the value documents of the first container; and the value-document processing apparatus sorts out the reject value documents of the first and second sub-stacks that belong to the contemplated deposit into the same reject pocket, and said reject value documents are post-processed jointly.

5. The method according to claim 1, wherein, upon insertion of the value documents of the different deposits, for at least one deposit the value documents of said deposit are divided into at least two sub-stacks in a container using at least one separating element, and that, upon bringing to account the respective deposit, the at least two sub-stacks of said deposit are brought to account jointly.

6. The method according to claim 5, wherein the value-document processing apparatus sorts out reject value documents rejected upon checking of the value documents into a reject pocket, with the sorted-out reject value documents of all sub-stacks that belong to the same deposit and were inserted into the same value-document container and were inserted into the input pocket of the value-document processing apparatus in immediate succession, being sorted out into the same reject pocket, and that said reject value documents are post-processed jointly.

7. The method according to claim 1, wherein, upon insertion of the value documents of the different deposits into the one or more containers, a first-type separating element is placed into the respective container at each boundary between value-document stacks of two different deposits, and that in the case of a deposit whose value-document stack extends over more than a maximum stack length along the removal direction in the respective container the value-document stack of said deposit is divided into at least two sub-stacks using at least one second-type separating element.

8. The method according to claim 1, wherein the value documents of the contemplated deposit are distributed over at least two containers such that the value documents of the contemplated deposit form a first sub-stack that is inserted in a first container, and form a second sub-stack that is inserted in a second container, with the first and second containers containing no value documents of other deposits; and the accounting of the contemplated deposit's sub-stacks inserted into the first and second containers is carried out jointly, independently of the order in which the value documents of the first container and of the second container are inserted into the input pocket of the value-document processing apparatus.

9. The method according to claim 1, wherein the value documents of the contemplated deposit are distributed over at least two containers such that the value documents of the contemplated deposit form a first sub-stack that is inserted at the end of a first container, and form a second sub-stack that is inserted at the start of a second container, with the first and/or second container also containing value documents of one or more other deposits, and the accounting of the sub-stacks of the contemplated deposit that are inserted into the first and second containers is carried out either jointly or separately from each other in dependence on the order in which the value documents of the first container and of the second container are inserted into the input pocket of the value-document processing apparatus.

10. The method according to claim 9, wherein if the order in which the value documents of the first and second containers are processed is such that the value documents of the second sub-stack are inserted into the input pocket of the value-document processing apparatus immediately after the value documents of the first sub-stack, then the value documents of the second sub-stack from the second container are brought to account in a joint accounting with the value documents of the first sub-stack from the first container.

11. The method according to claim 9, wherein the contemplated deposit contains, in addition to the first sub-stack and second sub-stack, at least one further sub-stack which is contained in a further container in which only the value documents of the contemplated deposit but no value documents of other deposits are contained; and if the order in which the first, second and further containers are processed is such that the value documents of the further container are inserted into the input pocket of the value-document processing apparatus immediately after those of the first container, and the value documents of the second container are inserted into the input pocket of the value-document processing apparatus immediately after the value documents of the further container, then the value documents of the first sub-stack from the first container and the value documents of the second sub-stack from the second container and the value documents of the further sub-stack from the further container are brought to account together in a joint accounting.

12. The method according to claim 9, wherein if the order in which the value documents of the first and second containers are processed is such that between the value documents of the first sub-stack and those of the second sub-stack value documents of another deposit from a next container are inserted into the input pocket, then an accounting of the contemplated deposit with regard to the first sub-stack from the first container is carried out between the processing of the first and second sub-stacks, and at a later time an accounting of the contemplated deposit with regard to the second sub-stack is carried out, being carried out separately from the accounting with regard to the first sub-stack, and that the mutually separate accountings of the two sub-stacks of the contemplated deposit are merged at a later time in order to carry out a final accounting of the contemplated deposit.

13. The method according to claim 9, wherein if the order in which the value documents of the first and second containers are processed is such that the value documents of the second sub-stack are inserted into the input pocket of the value-document processing apparatus before the value documents of the first sub-stack, then an accounting of the contemplated deposit with regard to the second sub-stack is carried out immediately after the processing of the value documents of the second sub-stack, and at a later time an accounting, separate therefrom, of the contemplated deposit with regard to the first sub-stack is carried out, and that the mutually separate accountings of the two sub-stacks of the contemplated deposit are merged at a later time in order to carry out a final accounting of the contemplated deposit.

14. A system for processing value documents of different deposits, comprising:

one or more containers, into which value documents of different deposits were inserted, with a separating element being placed into the respective container at each boundary between the value documents of two different deposits;

at least one value-document processing apparatus to which the containers into which the value documents of the different deposits were inserted are transported, and which checks the value documents of the different deposits and counts them stack by stack in order to establish a value-document number in dependence on the value-document type; and a transport device through which the value documents of the different deposits from the containers are inserted into an input pocket of the value-document processing apparatus, with the value documents being removed from the respective container along a removal direction and inserted into the input pocket of the value-document processing apparatus stack by stack;

an accounting device for automatically bringing to account the different deposits that were checked by the value-document processing apparatus;

a device which is configured for recording a beginning position and, where applicable, end position of the respective deposit, that was established for each deposit upon insertion of the value documents and then transmitted to the accounting device;

and wherein upon insertion of the value documents, for at least one contemplated deposit the value documents of the contemplated deposit are divided into at least two sub-stacks that are inserted into the same or into different containers; and wherein the accounting device is configured such that, in the case when the value-document processing apparatus checks in immediate succession at least two sub-stacks of the contemplated deposit that were inserted in the same or in different containers, it brings to account the value documents of the at least two sub-stacks jointly, with consideration of the contemplated deposit's beginning position and, where applicable, end position established upon insertion.

15. The system according to claim 14, wherein the accounting device is configured for establishing from the stack-based value-document number that was established upon the stack-by-stack counting for the at least two sub-stacks in dependence on the respective value-document type, with consideration of the contemplated deposit's beginning position and, where applicable, end position established upon insertion, a resultant value-document number for each value-document type present in the contemplated deposit, in order to bring to account the at least two sub-stacks of the contemplated deposit jointly.

16. A system for processing value documents of different deposits, comprising:

one or more containers, into which value documents of different deposits were inserted, with a separating element being placed into the respective container at each boundary between the value documents of two different deposits;

at least one value-document processing apparatus to which the containers into which the value documents of the different deposits were inserted are transported, and which checks the value documents of the different deposits and counts them stack by stack in order to establish a value-document number in dependence on the value-document type; and a transport device through which the value documents of the different deposits from the containers are inserted into an input pocket of the value-document processing apparatus, with the value documents being removed from the respective container along a removal direction and inserted into the input pocket of the value-document processing apparatus stack by stack;

an accounting device for automatically bringing to account the different deposits that were checked by the value-document processing apparatus;

a device which is configured for recording a beginning position and, where applicable, end position of the respective deposit, that was established for each deposit upon insertion of the value documents;

and wherein upon insertion of the value documents, for at least one contemplated deposit the value documents of the contemplated deposit are divided into at least two sub-stacks that are inserted into different containers; and wherein the accounting device is configured such that, in the case when the value-document processing apparatus checks in immediate succession at least two sub-stacks of the contemplated deposit that were inserted in different containers, it brings to account the value documents of the at least two sub-stacks jointly, with consideration of the contemplated deposit's beginning position and, where applicable, end position established upon insertion.

17. A system for processing value documents of different deposits, comprising:

one or more containers into which value documents of different deposits were inserted, with a separating element being placed into the respective container at each boundary between the value documents of two different deposits;

at least one value-document processing apparatus to which the containers into which the value documents of the different deposits were inserted are transported, and which checks the value documents of the different deposits and counts them stack by stack in order to establish a value-document number in dependence on the value-document type; and a transport device through which the value documents of the different deposits from the containers are inserted into an input pocket of the value-document processing apparatus, with the value documents being removed from the respective container along a removal direction and inserted into the input pocket of the value-document processing apparatus stack by stack;

an accounting device for automatically bringing to account the different deposits that were checked by the value-document processing apparatus;

a device which is configured for recording a beginning position and, where applicable, end position of the respective deposit, that was established for each deposit upon insertion of the value documents;

and wherein upon insertion of the value documents, for at least one contemplated deposit the value documents of the contemplated deposit are divided into at least two sub-stacks that are inserted into the same or into different containers; and wherein the value documents of the contemplated deposit are associated with the contemplated deposit on the basis of the established beginning position and, where applicable, end position without the use of header cards; and wherein the accounting device is configured such that, in the case when the value-document processing apparatus checks in immediate succession at least two sub-stacks of the contemplated deposit that were inserted in the same or in different containers, it brings to account the value documents of the at least two sub-stacks jointly, with consideration of the contemplated deposit's beginning position and, where applicable, end position established upon insertion.

* * * * *